United States Patent [19]

Flatt

[11] 4,082,404

[45] Apr. 4, 1978

[54] NOSE SHIELD FOR A GAS ACTUATED HIGH VOLTAGE BUSHING

[75] Inventor: Richard P. Flatt, Oconomowoc, Wis.

[73] Assignee: RTE Corporation, Waukesha, Wis.

[21] Appl. No.: 738,741

[22] Filed: Nov. 3, 1976

[51] Int. Cl.[2] ..... H01R 13/52

[52] U.S. Cl. ..... 339/111; 339/117 R; 339/143 R

[58] Field of Search ..... 339/111, 161, 117 R, 339/117 P, 143 R

[56] References Cited

U.S. PATENT DOCUMENTS

| | | | |
|---|---|---|---|
| 3,587,035 | 6/1971 | Kotski | 339/143 R X |
| 3,982,812 | 9/1976 | Boliver | 339/111 |
| 3,989,341 | 11/1976 | Ball | 339/111 |

*Primary Examiner*—Roy Lake
*Assistant Examiner*—DeWalden W. Jones
*Attorney, Agent, or Firm*—Ronald E. Barry

[57] ABSTRACT

In a high voltage bushing having a hollow tubular bore contact engageable with the probe of a high voltage cable terminator, a nose shield for reducing corona around the probe on close-in of the terminator with the bushing, the nose shield being formed of a conductive cylinder which is embedded within the bushing housing but is electrically isolated from the conductive cylinder in the bushing and is electrically connected to the conductive insert of the terminator on close-in.

8 Claims, 2 Drawing Figures

NOSE SHIELD FOR A GAS ACTUATED HIGH VOLTAGE BUSHING

BACKGROUND OF THE INVENTION

Gas actuated bushings of the type shown in the Kotski U.S. Pat. No. 3,587,035, entitled "Gas Shield for Load Break Cable Terminator" issued June 22, 1971, have been generally accepted for use at 8.3 KV and a 15.2 KV. At higher ratings 21.1 KV, difficulties have been encountered due to the voltage stress around the probe inside the arcing material. These probes go into corona due to the voltage stress from the close proximity of the probe to the conductive shield on the bushing. This corona hinders switching at these higher voltages.

SUMMARY OF THE INVENTION

The gas actuated high voltage bushing of the present invention alleviates the corona problem by the incorporation of a nose shield around the entrance to the bushing. The nose shield is electrically isolated during load make and load break and is electrically connected to the conductive insert of the terminator on complete close-in. Since there will be no potential difference between the probe and the conductive insert on close-in, corona is virtually eliminated.

DRAWINGS

Figure 1:
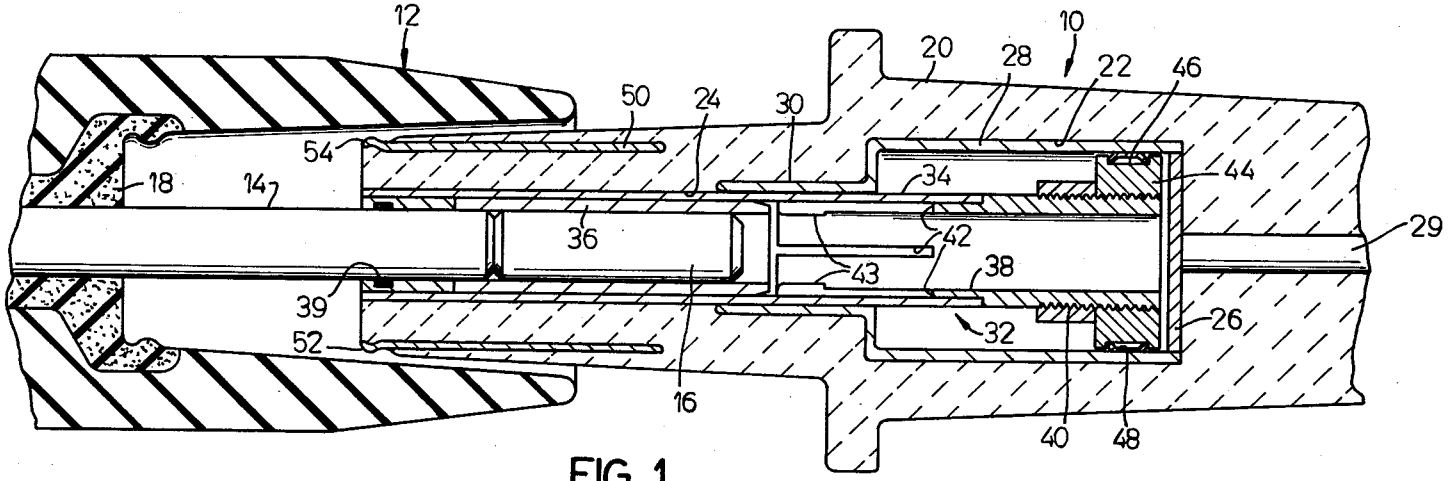
Figure 2:
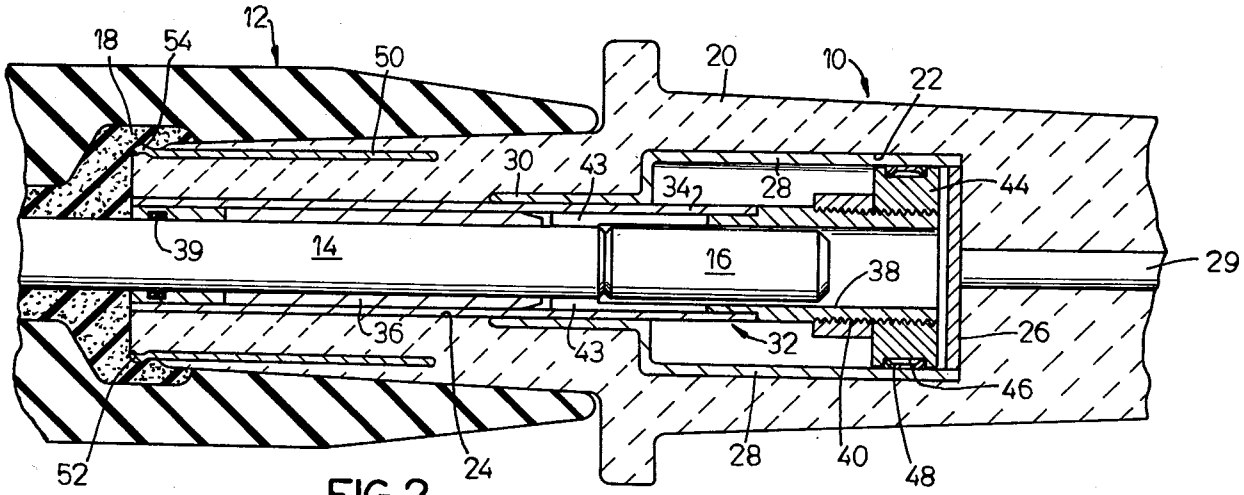

FIG. 1 is a side view in section of the bushing according to the invention showing the probe of a safe break terminator partially inserted into the bushing; and FIG. 2 is a side view in section showing the terminator on close-in with the bushing and the nose shield electrically connected to the terminator insert.

DESCRIPTION OF THE INVENTION

The high voltage bushing 10 according to the invention is used in conjunction with a safe break terminator 12 to provide load make and load break functions for a high voltage device. The terminator 12 includes a probe 14 having an arc extinguishing follower 16 mounted on the end. The terminator also includes a conductive elastomeric insert 18 on the inner surface of the housing which is connected to the probe 14 to eliminate corona in the terminator.

The bushing 10 includes an insulating housing 20 having a central cavity 22 and an elongated bore 24 connected to said cavity. An electrically conductive cylinder 28 is provided within the cavity 22 and includes a reduced diameter tubular section 30 which extends partially into the bore 24. The cylinder 28 is closed by means of a conductive plate 26 which is electrically connected to the cylinder 28. The plate 26 is connected to an electrical device by means of a conductor 29.

A contact-snuffer assembly 32 is mounted within the bore 24 in the bushing 10 for electrically engaging the rod contact 14 in the terminator 12. In this regard, the contact-snuffer assembly 32 includes a tubular insulating member 34 which is mounted for reciprocal movement in the bore 24 of the bushing. An arc-interrupting sleeve 36 and a bore contact 38 are provided within the tube 34.

The bore contact 38 is positioned at the internal end of the tube 34 and extends partially into the cylinder 28. The bore contact 38 includes a threaded section 40 at the end and a number of slits 42 which define flexible contacts 43. The contact-snuffer assembly 32 is moved under fault current conditions by means of a piston 44 mounted on the threaded section 40 of the bore contact 38. The piston 44 is positioned within the cylinder 28 and is provided with an annular groove 46 on the outer periphery of the piston 44.

Electrical communication between the piston 44 and the cylinder 28 is provided by means of a current interchange element in the form of a band 48 positioned within the groove 46. The current interchange band is of the type generally referred to as a louvered band and provides continuous contact during movement of the piston within the cylinder 28. Other current interchange elements can be used in the place of the band.

As is generally understood in the art, on close-in, the gases generated by the sleeve 36 and the follower 16 due to the heat of the arc are confined within the tube 24 and directed into the cylinder 28 through the center of the bore contact 38. In the event of a fault current condition, the rapid expansion of gases builds up sufficient pressure between piston 44 and end plate 26 to move the piston 44 and the contact-snuffer assembly 32 rapidly into engagement with the probe 14.

Means can be provided on the end of the sleeve 30 to seal the gases in the tube 36. Such means is in the form of a seal ring or valve 39 provided at the end of the tube 34.

In accordance with the invention, corona around the probe 14 is reduced by means of a nose shield 50. As seen in FIG. 1 of the drawing, the nose shield is shown in the form of a cylinder 52 formed of electrically conductive material and embedded within the housing 20. Although shown in the form of a cylinder, the nose shield can be made in other forms which surround the open end of the bushing. A small section 54 of the cylinder is exposed at the end of the bushing. As seen in FIG. 1, the nose shield 50 is normally electrically isolated from the conductive cylinder 28 in the bushing and the conductive insert 18 of the terminator.

During close-in, the conductive insert 18 is not electrically connected. The nose shield 50 has a potential somewhat in between that of the probe 14 and the shield 28. This reduction in potential reduces corona during close-in.

On completion of close-in of the terminator 12 with the bushing 10, as seen in FIG. 2, the conductive insert 18 on the terminator will electrically engage the exposed section 54 of the nose shield. The electrical potential of the insert 18 and nose shield 50 will then be the same as the probe 14. The electrical potential difference between the probe 14 and shield 50 will be reduced to zero eliminating any corona.

The nose shield 50 is close enough to the cylindrical section 30 of the conductive cylinder 28 to shield the probe 14 when closed with the bore contact 38.

Although the shield 50 is shown electrically connected to the conductive insert, it could also be connected directly to the probe 14. This can be accomplished by substituting an electrically conductive gasket for the O-ring 39 and connecting the gasket directly to the shield 50.

The embodiments of the invention in which an exclusive property or privilege is claimed are defined as follows:

1. A high voltage bushing for terminating a high voltage cable having a cable terminator connected thereto, the terminator including a probe and a conductive insert, the bushing comprising a housing having an elongated bore and a bore contact movable in the bore in the housing and a nose shield comprising an electrically conductive member embedded within and surrounding the open end of the bore in the bushing, said member being partially exposed at one end for engagement with the conductive insert of the terminator on close-in of the probe with the bore contact in the bushing.

2. A high voltage bushing comprising:

a housing, a cavity within the housing and a contact-snuffer assembly mounted for axial movement within the housing in response to an increase in gas pressure within the cavity in the housing, electrically conductive means embedded within and partially extending outwardly from the bushing, the exposed portion of the conductive means being positioned to engage the electrically conductive insert of a high voltage cable terminator on close-in whereby the electrical potential difference between the terminator and the shield is eliminated.

3. The bushing according to claim 2 wherein said conductive means comprises an electrically conductive member surrounding the open end of the bushing.

4. A high voltage cable terminator including a plug having a recess, a probe mounted in said recess and an electrically conductive insert connected to the probe, and a bushing including a housing having a gas-actuated contact-snuffer assembly mounted therein, the improvement comprising:

a conductive shield mounted in the bushing to surround the probe on close-in and being partially exposed to electrically engage the electrically conductive insert on the terminator on close-in.

5. Electrical connector apparatus comprising:

a bushing having a bore contact mounted for reciprocal movement, and a connector having a conductive probe moveable independently into engagement and disengagement with the bore contact, said connector including a conductive insert surrounding the probe and being spaced from the end thereof, and an electrically conductive shield partially embedded in said bushing to encircle said probe on engagement with said bore contact, said shield being electrically connected to said conductive insert on engagement of said probe with said bore contact whereby the electrical potential of said shield and probe will be the same.

6. An electrical connector system comprising:

a bushing including an insulated support member, and a bore contact mounted in said member, and a terminator movable independently of said bushing and including a probe for engaging and disengaging said bore contact, said bushing including an electrically conductive shield positioned to surround said probe on engagement with said bore contact, and means for electrically connecting said shield to said probe on engagement of said probe with said bore contact whereby the electrical potential of said shield and probe are the same.

7. The system according to claim 6 wherein said shield is partially embedded in support member.

8. The system according to claim 6 wherein said connecting means comprises an electrically conductive gasket mounted in the end of the bushing and being electrically connected to said shield.

* * * * *